United States Patent [19]

Alheid

[11] 4,120,349

[45] Oct. 17, 1978

[54] HEAT TRANSFER ROLL

[75] Inventor: Robert J. Alheid, Beloit, Wis.

[73] Assignee: Beloit Corporation, Beloit, Wis.

[21] Appl. No.: 731,433

[22] Filed: Oct. 12, 1976

[51] Int. Cl.[2] ..... F28D 11/02

[52] U.S. Cl. ..... 165/89; 34/124

[58] Field of Search ..... 165/89, 90; 34/124, 34/125

[56] References Cited

U.S. PATENT DOCUMENTS

| | | | |
|---|---|---|---|
| 2,677,899 | 5/1954 | Ohlson et al. | 165/89 X |
| 2,707,836 | 5/1955 | Garrett | 34/124 |

FOREIGN PATENT DOCUMENTS

| | | | |
|---|---|---|---|
| 888,977 | 9/1953 | Fed. Rep. of Germany | 34/124 |
| 743,336 | 12/1943 | Fed. Rep. of Germany | 34/125 |

*Primary Examiner*—Charles J. Myhre
*Assistant Examiner*—Theophil W. Streule, Jr.
*Attorney, Agent, or Firm*—Hill, Gross, Simpson, Van Santen, Steadman, Chiara & Simpson

[57] ABSTRACT

A rotary hollow shell cylindrical heat transfer roll for either chilling or heating a web has a device therein for controlling a heat transfer liquid to flow as a uniform thin layer stream in heat transfer relation to the inner cylindrical surface of the roll substantially throughout the width and limited to substantially the circumferential length of the area of the outer periphery of the roll over which the web travels. The direction of flow of the heat transfer stream is opposite to the direction of rotation of the roll.

12 Claims, 2 Drawing Figures

Figure 1:
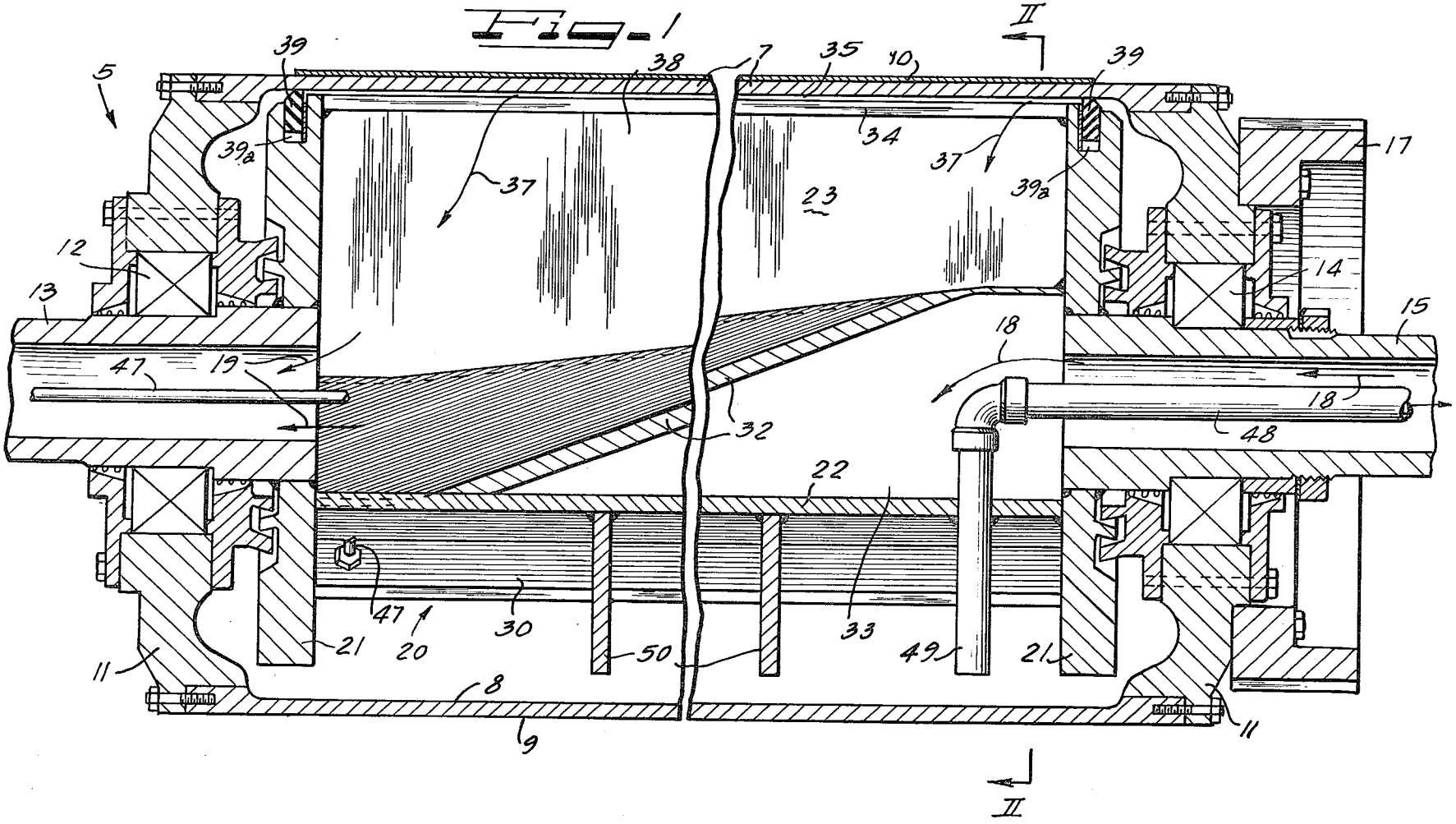

II
II
5
7
8
9
10
11
12
13
14
15
17
18
19
20
21
22
23
30
32
33
34
35
37
38
39
39a
47
48
49
50

HEAT TRANSFER ROLL

This invention relates to improvements in heat transfer rolls of the type adapted for chilling or heat treating a web running in heat transfer relation on the periphery of the roll.

Heat transfer rolls are known in which a heat transfer liquid is circulated in contact with the inner cylindrical surface of the rolls in a spiral fashion, as exemplified in U.S. Pat. No. 2,837,833. According to that expedient, a helical path is defined by bars requiring the heat transfer liquid, such as water, to travel in a substantially parallel cross flow with respect to the direction of movement of the web to be treated over the roll shell perimeter surface. There is a tendency for temperature fall-off as the liquid travels spirally from one end to the other end of the roll, whereas the optimum condition should be such as to effect substantially uniform heat transfer along the entire length area of the roll adapted to run in heat transfer relation to the web being treated.

It is therefore an important object of the present invention to overcome the disadvantages, deficiencies, inefficiencies, shortcomings, and problems inherent in prior heat transfer rolls and to provide a new and improved heat transfer roll for effecting heat transfer according to which optimum uniformity of heat transfer is attained.

Another object of the invention is to provide new and improved means in a heat transfer roll for attaining uniform thin layer stream heat transfer along the inner cylindrical surface of a heat transfer roll shell substantially throughout the entire length of the segmental roll surface area over which a web to be treated travels in operation.

A further object of the invention is to provide new and improved means for controlling heat transfer liquid circulation in a heat transfer roll.

Still another object of the invention is to provide a new and improved method of effecting heat transfer liquid circulation in a heat transfer roll.

In accordance with the principles of the present invention there is provided a hollow rotary heat transfer roll having a cylindrical heat transfer wall providing an inner cylindrical surface and an outer cylindrical periphery, on a substantial width and limited length circumferential segmental area of which a web is adapted to travel in heat transfer relation, comprising means for circulating a heat transfer liquid through the interior of the roll, and means within the roll for controlling the liquid to flow counter to the direction of rotation of the roll and in a substantially uniform and unbroken thin sheet-like layer stream in heat transfer relation to the inner cylindrical surface of the roll and substantially limited to and constrained to be in alignment with the area on which the web travels, whereby heat transfer through the heat transfer wall between the liquid stream and the web is effected with optimum heat transfer efficiency attained with minimum heat transfer liquid flow rate.

Figure 2:
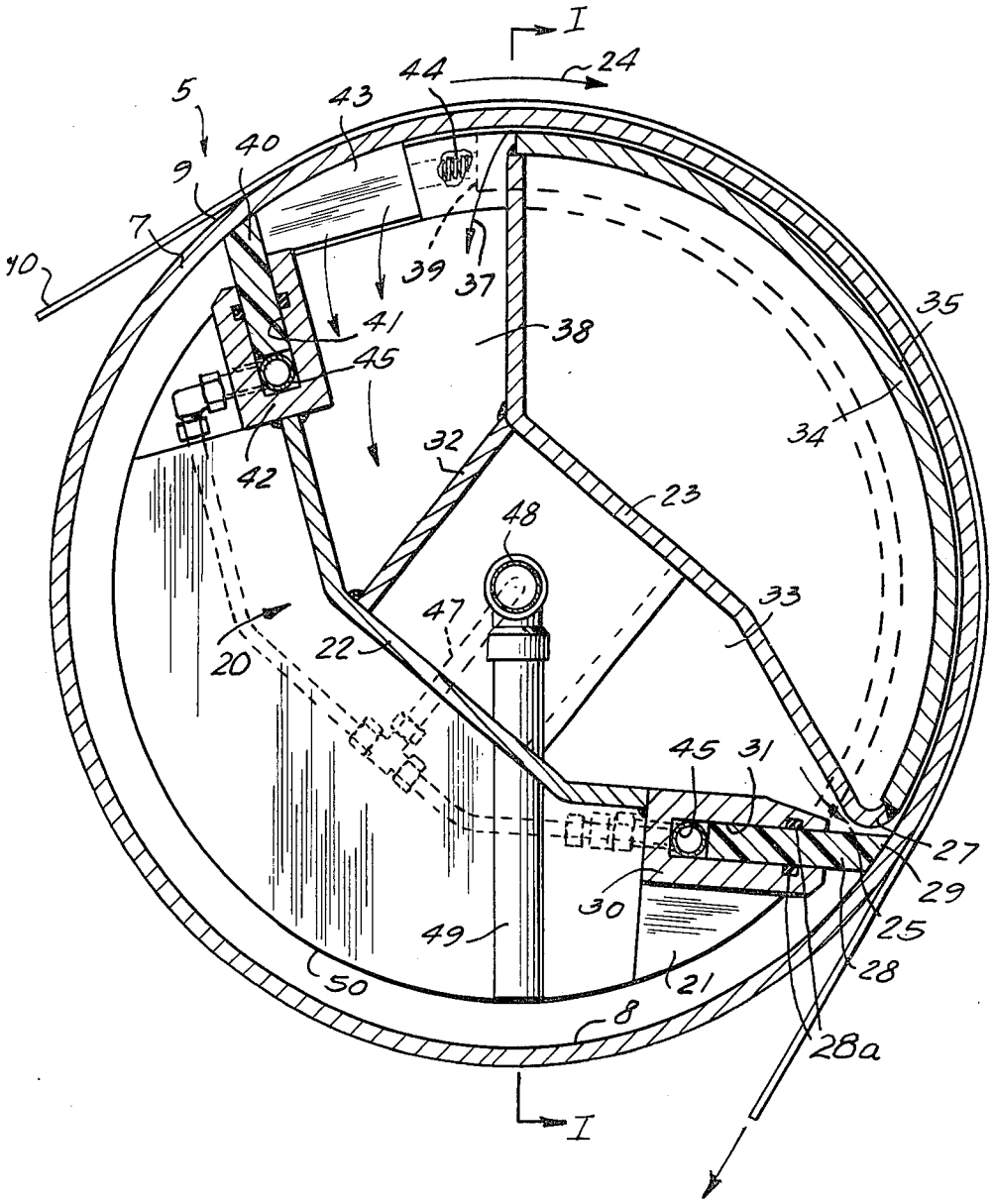

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure, and in which:

FIG. 1 is a longitudinal, fragmental sectional elevational detail view through a heat transfer roll embodying features of the invention and taken substantially along the line I—I of FIG. 2; and FIG. 2 is a transverse vertical sectional detail view taken substantially along the line II—II of FIG. 1.

A hollow rotary heat transfer roll 5 embodying features of the invention has a cylindrical heat transfer shell wall 7 providing an inner cylindrical surface 8 and an outer cylindrical periphery 9 on a substantial width and limited length circumferential segmental area of which a web 10 is adapted to run in heat transfer relation. As shown in FIG. 2, the web 10 may run in engagement with about 180° or less of the roll perimeter 9. At each end, the roll shell wall 7 is secured to a head 11. At one end of the roll the head 5 is supported rotatably by means of bearings 12 on a suitable tubular shaft 13 adapted to be fixed non-rotatably on a suitable supporting frame (not shown). At the opposite end of the roll 5 the head 11 is rotatably supported by means of bearings 14 on a suitable tubular non-rotary shaft 15 supported coaxially with the shaft 13 by the frame. Means for driving the roll 5 rotatably may comprise a pulley or gear 17 fixedly secured to one of the heads 11.

Heat transfer liquid such as water is circulated in heat transfer relation through the interior of the roll 5, being introduced as indicated by directional arrows 18 through the hollow shaft 15 and exiting from the opposite end of the roll through the hollow shaft 13 as indicated by directional arrows 19.

Within the hollow interior of the roll 5, means in the form of a device 20 are provided for controlling the heat transfer liquid to flow as a uniform, unbroken, thin, sheet-like layer stream in heat transfer relation to the inner surface 8 substantially limited to and in alignment with the longitudinal extent or width and the circumferential length of the segmental area of the roll over which the web 10 travels in operation. To this end, the device 20 is mounted in stationary relation within the hollow roll 5, and conveniently carried by the shafts 13 and 15.

In a rugged, efficient construction, the device 20 comprises a frame which may be a welded structure formed from steel parts of suitable grade for the intended purpose. At each end, the frame comprises an annular disk-like member 21, encircling and welded to the inner ends of the respective shafts 13 and 15. Extending between and welded to the end members 21 are members defining means for controlling flow of the heat transfer fluid from the point of entry at the inlet provided by the passage through the hollow shaft 15, to the point of exit provided by the passage through the hollow shaft 13, and comprising longitudinally extending spaced suitably configurated partition members 22 and 23 defining a chamber therebetween. In a preferred arrangement, the partition member 22 sweeps upwardly from a lower margin below the shafts 13 and 15, generally obliquely to a position wherein its upper margin is near the top of the chamber within the roll 5 and adjacent to the up-running side of the roll shell wall 7 in operation, the direction of rotation being indicated in FIG. 2 by the directional arrow 24. Similarly, the partition member 23 extends from a lower margin which is lower than the shafts 13 and 15 and then diagonally upwardly above the shafts 13 and 15 to an upper margin which is preferably on the vertical diameter of the roll 5.

At their lower margins the partition members 22 and 23 have means (best seen in FIG. 2) defining a slit nozzle 25 for directing the heat transfer fluid toward the inner surface 8 of the shell walls 7 along a longitudinal line which is located at the lower portion of the down running side of the roll 5 and starting in substantial alignment with the offrunning end of the segmental area of the roll periphery located at substantially the point at which the web 10 leaves the roll perimeter 9. In a preferred construction, the slit defining means comprise on the lower margin of the partition member 23 a generally upturned arcuate formation 27. On the partition 22 the nozzle means comprise a dynamic sealing element 28 of generally plank-like form having a sealing edge 29 in sealing contact with the roll surface 8 and having its ends in engagement with the respective inner faces of the end members 21. Dynamic support for the sealing member 28 is provided by a marginal guide element 30 on the partition 22 and having a socket 31 of a width complementary to the thickness of the seal member 28 and oriented to guide the seal member toward the surface 8 in narrow slit nozzle relation to the nozzle forming marginal portion 27 of the partition 23. Leakage past the seal member 28 to the interior of the socket 31 is substantially prevented by the sealing strips 28*a* mounted in the wall defining the socket. To direct all inflowing heat transfer fluid from the inlet shaft 15 to the nozzle 25, separating and deflector means in the form of a transverse partition panel 32 is secured as by means of welding between the partitions 22 and 23 and slants from a position at one end located above the inlet shaft 15 to a position at the other end below the outlet shaft 13, but substantially spaced from the nozzle 25. In effect, the transverse partition 32 defines with the partition members 22 and 23 a substantial volume heat transfer fluid delivery chamber 33 which is of ample capacity to assure optimum uniformity of delivery of the heat transfer fluid throughout the length of the slit nozzle 25.

From the nozzle 25, the heat transfer fluid is controlled to flow in substantially uniform, unbroken, thin sheet-like layer stream in heat transfer relation to the inner cylindrical surface 8 counter to the direction of rotation of the roll 5, substantially throughout the entire width, considered lengthwise and the circumferential extent or length of the roll 5, of the segmental area of the perimeter 9 over which the web travels. This comprises a substantial segment of the shell wall 7 extending from adjacent to the tangent at which the travelling web 10 engages the perimeter 9 to the line along which the nozzle 25 delivers the heat transfer fluid to the surface 8. To this end, means in the form of a semi-cylindrical control plate 34 having a convex surface complementary to the surface 8 defines with the surface 8 a narrow semicylindrical gap 35 which will control the heat transfer stream to the minimum sheet-like layer or film to attain optimum heat transfer value. From the nozzle margin portion 27, the arcuate member 34 extends to the upper edge of the partition member 23 and more particularly to adjacent the onrunning end of the segmental area of the roll periphery over which the web 10 runs, at which point the spent heat transfer fluid indicated by the directional arrows 37 drops into a collection chamber 38 between the upper portions of the partition members 22 and 23 and above the transverse partition member 32 and from which the spent fluid exits through the outlet provided by the hollow shaft 13. It will be appreciated, of course, that the arcuate control plate 34 is thoroughly secured as by welding to the opposite top and bottom edges of the partition member 23 and to the end members 21.

Leakage of the heat transfer fluid from the ends of the control gap 35 at the end members 21 is substantially prevented by means of arcuate end seals 39 mounted in suitable sockets 39a in the edges of the end members 21 and thrusting sealingly against the roller shell surface 8. To substantially prevent escape of the spent heat transfer fluid beyond the partition member 22 a plank-like seal member 40 is carried in a complementary socket 41 in a marginal socket member 42 on the upper edge of the partition member 22 and sealingly engaging the inner cylindrical surface 8 of the roll wall 7. To seal the spent fluid substantially against escaping from the ends of the chamber 38, seal blocks 43 are carried by the end members 21, as best seen in FIG. 2, in cooperation with the seal members 40 and the seal strips 39. Biasing spring means in the form of compression springs 44 are provided between the adjacent ends of the seal strips 39 and the seal blocks 43 to maintain these seal members in reasonably firm sealing engagement with the roll surface 8.

Means are provided for biasing the plank-like seal members 28 and 40 toward the surface 8, herein comprising tubular air springs 45 mounted in the bottoms of the sockets 31 and 41, respectively, behind the seal members 28 and 40. Air under pressure from any suitable mill source is supplied to the air springs 45 by means comprising a branched air conduit 47, which enters the device 20 through the passage in the hollow shaft 13.

Heat transfer fluid that may leak past the various seals and collect in the bottom of the chamber within the hollow roll 5 is withdrawn by means of a suction duct 48 extending through the passage in the shaft 15 and having a suction terminal inlet 49 extending downwardly through the partition member 22 into the sump in the bottom of the roll chamber.

Reinforcing means in the form of transversely extending longitudinally spaced radial vane-like plates 50 are welded onto the back of the partition member 22 and the backs of the socket elements 30 and 42.

In operation, whether the heat transfer roll 5 is used as a heating roll or as a chill roll, the heat transfer liquid is supplied under adequate pressure to attain the desired heat transfer results as the fluid travels the heat transfer stream control gap 35. Assuming the heat transfer roll 5 to be used as a chill roll for chilling film plastic, represented by the web 10, extruded toward the chill roll perimeter 9, the heat transfer fluid may efficiently be in the form of water under about 50 psi head pressure and supplied at about 65° F. Although the extruded film plastic, when it initially contacts the chill roll surface 9 may be at about 600°–650° F., the cylindrical roll wall 7 is amply chilled by the efficient heat transfer attained by means of the heat transfer liquid in the stream gap 35 to cool the film to about 120° F. A typical chill roll, may be about 40 to 120 inches long and about 16 to 30 inches in diameter. In such a roll, efficient results are attained by having the width of the gap 35, and thereby the thickness of the heat transfer fluid stream about 0.060 inch.

By reason of the efficient heat transfer attained, the apparatus and method of the present invention permit a substantially smaller diameter chill roll to be employed to attain the same capacity as a larger diameter roll, for example a 20 inch diameter roll will provide about the same cooling capacity as a 30 inch diameter roll utilizing prior heat transfer expedients. Further the water flow rate to attain equally efficient cooling may be about one-half the water flow rate of the prior art expedients.

It will be understood that variations and modifications may be effected without departing from the spirit and scope of the novel concepts of this invention.

I claim as my invention

1. A hollow rotary heat transfer roll having a cylindrical heat transfer wall providing an inner cylindrical surface and an outer cylindrical periphery, on a substantial width and limited length circumferential segmental area of which a web is adapted to travel in heat transfer relation, comprising in combination:

means for circulating a heat transfer liquid through the interior of said roll;

and means within the roll for controlling the liquid to flow counter to the direction of rotation of the roll and in a substantially uniform and unbroken thin sheet-like layer stream in heat transfer relation to said inner cylindrical surface substantially limited to and constrained to be in alignment with said segmental area on which the web travels;

whereby heat transfer through said heat transfer wall between the liquid stream and the web is effected with optimum heat transfer efficiency attained with minimum heat transfer liquid flow rate.

2. A combination according to claim 1, wherein said means within the roll comprise a stationary device defining a slit nozzle extending throughout the width of the stream and through which nozzle the stream is initiated to flow along said inner cylindrical surface starting in substantial alignment with the offrunning end of said segmental area of the roll periphery.

3. A combination according to claim 2, wherein said means within the roll comprise a semi-cylindrical controlling member complementary to said cylindrical surface leading from said nozzle to adjacent the onrunning end of said segmental area of the roll periphery and in narrow gap relation to said cylindrical surface to define the thickness of said stream.

4. A combination according to claim 2, wherein said means within the roll for controlling the liquid comprise a heat transfer liquid delivery chamber communicating with said slit nozzle and delivering the heat transfer liquid substantially uniformly throughout the length of said slit nozzle.

5. A combination according to claim 4, wherein said means within the roll comprise a receiving chamber separated from said delivery chamber and communicating with said sheet-defining gap adjacent to the onrunning end of said segmental area of the roll periphery to receive spent heat transfer liquid from said stream.

6. A combination according to claim 5, including sealing means carried by and disposed between the means within the roll and said inner cylindrical surface for retaining the heat transfer stream substantially within said gap and limited in travel from said slit nozzle to said receiving chamber, and means for biasing the sealing means into sealing engagement with said inner cylindrical surface.

7. A combination according to claim 6, wherein said means within the roll are located above a sump area defined by a lower portion of said cylindrical wall within the roll and means for removing heat transfer liquid which may leak into the sump past the sealing means.

8. A combination according to claim 1, wherein the heat transfer liquid comprises water under about 50 pounds per square inch head pressure supplied at about 65° F. for chilling extruded film plastic which initially contacts said segmental area of the roll at about 600°-650° F., said roll being from about 40 inches to about 120 inches in length and about 16 to 30 inches in diameter, the thickness of the heat transfer fluid stream being about 0.060 inch.

9. A hollow rotary heat transfer roll having a cylindrical heat transfer wall providing an inner cylindrical surface and an outer cylindrical periphery, on a substantial width and limited length circumferential segmental area of which a web is adapted to travel in heat transfer relation, comprising in combination:

annular end structures carrying said cylindrical heat transfer wall of the roll;

non-rotary hollow shafts on which said end structures are respectively rotatably mounted;

means for rotatably driving the roll;

means within the roll for controlling the liquid to flow counter to the direction of rotation of the roll and in a substantially uniform and unbroken thin sheet-like layer stream in heat transfer relation to said inner cylindrical surface substantially limited to and constrained to be in alignment with said segmented area on which the web travels, said means within the roll comprising:

a device stationarily supported by said shafts and including means defining a delivery chamber in heat transfer liquid supply communication with a passage through one of said shafts, a slit nozzle in communication with said delivery chamber and initiating said stream substantially in alignment with the offrunning end of said segmental area, means on said device extending from said nozzle to adjacent the onrunning end of said area and defining with said cylindrical surface a heat transfer liquid stream gap, a spent heat transfer liquid receiving chamber communicating with a terminal end of said gap adjacent to said onrunning end of said area, and means effecting communication between said receiving chamber and an outlet passage through the other of said shafts;

whereby heat transfer through said heat transfer wall between the liquid stream and the web is effected with optimum heat transfer efficiency attained with minimum heat transfer liquid flow rate.

10. A combination according to claim 9, wherein said means on said device defining with said cylindrical surface a heat transfer liquid stream gap comprises a semi-cylindrical controlling member complementary to said cylindrical surface leading from said nozzle to adjacent the onrunning end of said segmental area of the roll periphery and in narrow gap relation to the cylindrical surface to define the thickness of said stream.

11. A combination according to claim 9, including sealing means carried by and disposed between said device and said cylindrical surface for retaining the heat transfer stream substantially within said gap and limited in travel from said slit nozzle to said receiving chamber, and means for biasing the sealing means into sealing engagement with said inner cylindrical surface.

12. A combination according to claim 9, wherein the heat transfer liquid comprises water under about 50 pounds per square inch head pressure supplied at about 65° F. for chilling extruded film plastic which initially contacts said segmental area of the roll at about 600°-650° F., said roll being from about 40 inches to about 120 inches in length and about 16 to 30 inches in diameter, the thickness of the heat transfer fluid stream being about 0.060 inch.

* * * * *